US005897032A

United States Patent [19]

Ellion et al.

[11] Patent Number: 5,897,032

[45] Date of Patent: Apr. 27, 1999

[54] INVERTIBLE SPRAY DISPENSING CONTAINER

[76] Inventors: M. Edmund Ellion, 3660 Woodstock Rd., Santa Ynez, Calif. 93460; James C. Pfautz, 325 Clopston Hill, Sherwood Forest, Mass. 21405

[21] Appl. No.: 08/866,037

[22] Filed: May 30, 1997

Related U.S. Application Data

[63] Continuation-in-part of application No. 08/618,296, Mar. 18, 1996, abandoned.

[51] Int. Cl.[6] ..... B65D 83/00

[52] U.S. Cl. ..... 222/189.1; 222/211; 222/321.4; 222/376; 222/382; 222/383.1; 222/402.18; 222/402.19; 222/464.2

[58] Field of Search ..... 222/211, 189.06, 222/189.09, 189.1, 189.11, 402.1, 321.4, 321.3, 321.7, 321.9, 376, 382, 383.1, 375, 402.18, 402.19, 464.1, 464.2

[56] References Cited

U.S. PATENT DOCUMENTS

| | | | |
|---|---|---|---|
| 2,681,252 | 6/1954 | Tuttle | 222/464.2 X |
| 2,980,342 | 4/1961 | Armour | 222/211 X |
| 3,260,421 | 7/1966 | Rabussier | 222/402.18 X |
| 3,733,013 | 5/1973 | Doyle | 222/402.19 |
| 3,785,537 | 1/1974 | Appleby et al. | 222/382 X |
| 4,019,661 | 4/1977 | Szabo | 222/376 |
| 4,122,979 | 10/1978 | Laauwe | 222/211 X |
| 4,142,652 | 3/1979 | Platt | 222/464.2 X |
| 4,272,257 | 6/1981 | Ellion et al. | 55/38 |
| 4,398,654 | 8/1983 | Pong et al. | 222/402.1 |
| 4,418,846 | 12/1983 | Pong et al. | 222/402.1 |
| 4,529,414 | 7/1985 | Naess | 55/46 |
| 4,530,450 | 7/1985 | Nandagiri | 222/402.1 |
| 4,546,905 | 10/1985 | Nandagiri et al. | 222/464.2 X |
| 4,775,079 | 10/1988 | Grothoff | 222/376 X |
| 5,125,543 | 6/1992 | Rohrabacher et al. | 222/211 |

FOREIGN PATENT DOCUMENTS

| | | | |
|---|---|---|---|
| 810352 | 8/1951 | Germany | 222/464.2 |

*Primary Examiner*—Kevin P. Shaver
*Attorney, Agent, or Firm*—Watson Cole Grindle Watson, P.L.L.C.

[57] ABSTRACT

This invention is a spray bottle having unique flow passages that when wetted provide restrictions that allow only liquid to be dispensed either in the upright or inverted position. A gas rejection device of numerous configurations are incorporated into the spray bottle with minimum or no additional cost to manufacturing the spray bottle. Liquid rejection devices permit air to replace the dispensed liquid in order to prevent the collapse of the plastic bottle without leaking liquid in the inverted position.

25 Claims, 5 Drawing Sheets

FIG. 8
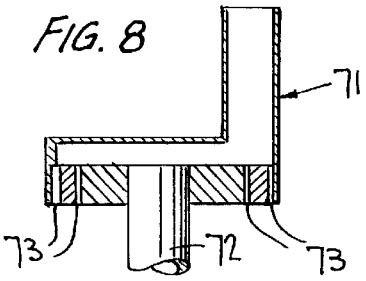
FIG. 10
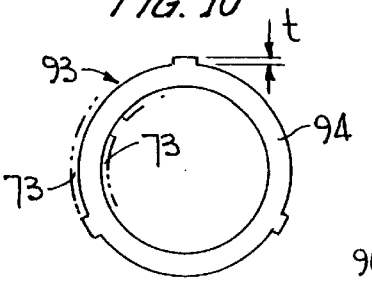
FIG. 11
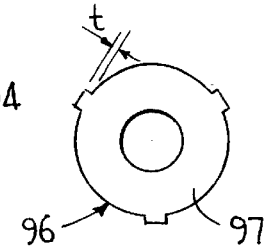
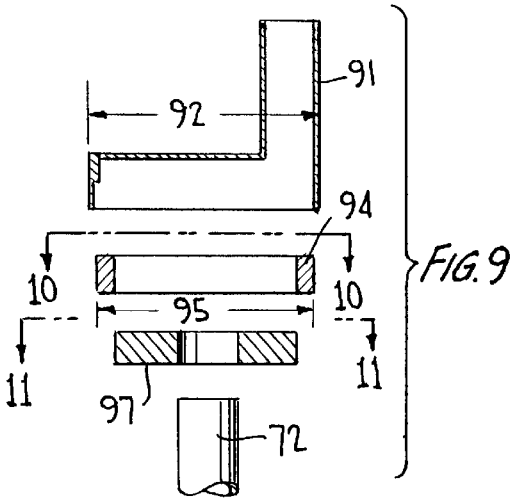
FIG. 9
FIG. 12
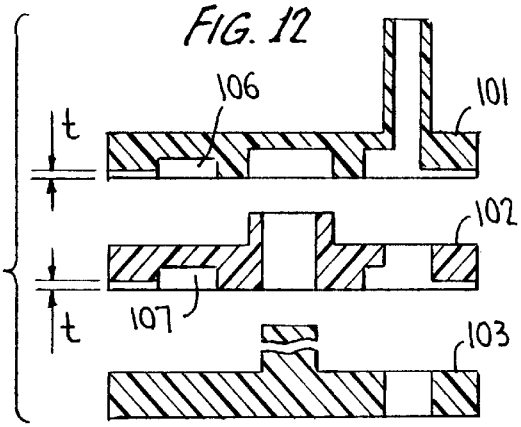
FIG. 13A
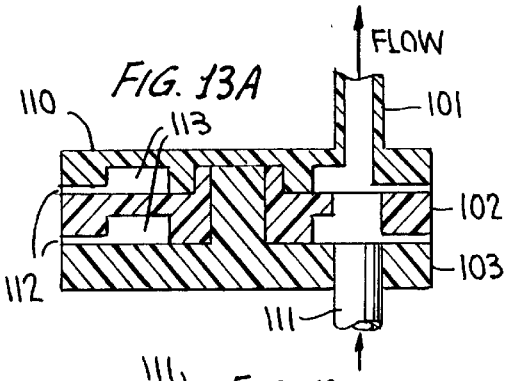
FIG. 18
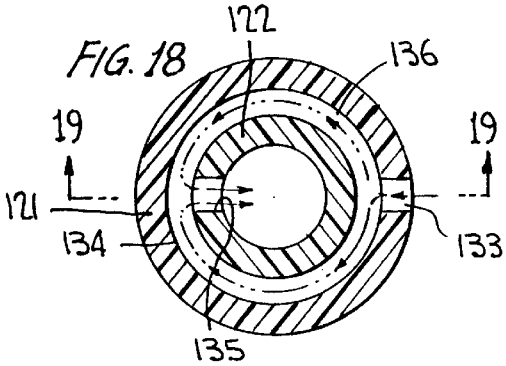
FIG. 13B
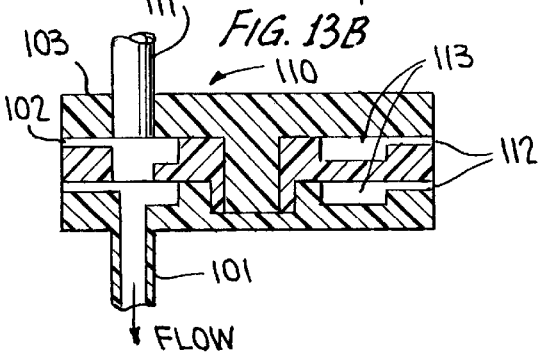
FIG. 19
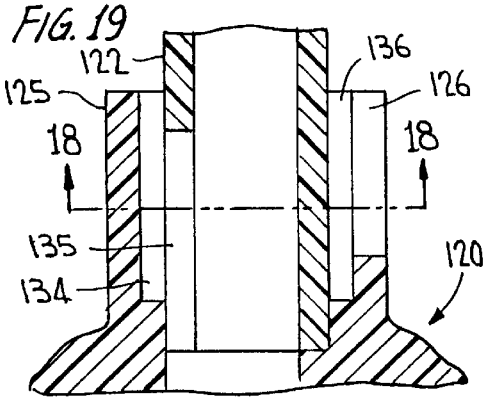

INVERTIBLE SPRAY DISPENSING CONTAINER

CROSS REFERENCE TO OTHER APPLICATION

This is a continuation-in-part of U.S. patent application Ser. No. 08/618,296, filed Mar. 18, 1996 entitled "An Invertable Spray Bottle".

FIELD OF THE INVENTION

This invention relates to spray bottles or cans for dispensing a liquid in a jet or atomization mode by means of an attached hand pump or by a pressurized gas and, more particularly, to a novel feed structure that, as a result of surface tension forces, allows liquid to be expelled while preventing the flow of gas regardless of the orientation of the container.

BACKGROUND OF THE INVENTION

There are two basic spray bottle or spray can configurations: one employs a hand pump (sometimes referred to as "trigger") device to draw the liquid up the feed tube (sometimes referred to as "dip tube") and then sprays the liquid out of the exit port; the second employs a pressurized gas to force the liquid contents out when the exit value is actuated. The use of hand pump bottles or pressurized cans to dispense a wide variety of substances such as glass cleaner, paint, and perfume, is widespread. Most of these containers have a single dip tube with an open end that extends into the liquid contents when the container is held in an upright position. However, when the container is inverted, the dip tube entrance is exposed to gas, and then only gas can be expelled from the container.

There are numerous patents which relate to the design of novel feed structures and hand pumps that can operate in either the fully upright position or the fully inverted position. The teachings of many of these patents are based on using check valves that are dependent on the force of gravity. One group (e.g. Grothoff U.S. Pat. No. 4,775,079) employs one or two balls that open or close flow passages depending on the orientation of the container utilizing the force of gravity. The other group (e.g. Ramsey U.S. Pat. No. 3,733,013) employs slugs that open or close flow passages and also utilize the force of gravity. When the bottle is partially inverted so that the open end of the dip tube is not in contact with liquid, but the component of the force of gravity is insufficient to move the ball or slug to either seat or unseat the port, the system will expel gas rather than liquid. Because of the difficulty of obtaining an acceptable gas seal with a ball or slug which is held in position by gravity, none of these patents teaches a concept that will reliably operate at orientations between the fully upright and the fully inverted positions.

Another group of patents describes dip tube configurations that will pass some types of fluids but not others. These concepts do not require check valves to control the flow into the dip tube but can operate only in the upright position. One type is for dispensing a three-phase system wherein phase I is a gaseous propellant and phases II and III are two immiscible liquids. In these patents, a dip tube is described that allows one phase of material to pass but prevents the entrance of another phase. In particular, Pong et al (U.S. Pat. No. 4,418,846) describes two immiscible liquids, one of which is a lipophilic phase and the other is a non-lipophilic phase. The dip tube has an open end through which the non-lipophilic phase flows and a tubular structure formed of a lipophilic material having multi-directional pores through which the lipophilic phase flows. The lipophilic liquid is thereby combined with the non-lipophilic liquid and the combination is passed through the valve means and is dispensed through the valve. Pong et al (U.S. Pat. No. 4,398,654) describes a similar dip tube with an open end through which can pass an aqueous liquid and a tubular structure through which a non-aqueous liquid will flow. These structures operate satisfactorily only if the container is in an upright position.

There is yet another patent which is of interest in the teaching of the present patent. This patent (Naess U.S. Pat. No. 4,529,414) describes a design for the separation of gas from a liquid in a flow system having at least one permeable blocking layer so arranged along the length of the pipe that the liquid remains on the underside of the blocking medium. This system relies on surface tension and capillary forces to separate the gas from the liquid. It is of interest only because it employs surface tension forces to separate the gas and liquid since it is not related to spray bottles in any manner.

There are several patents for propellant feed systems that operate in zero or near zero gravity fields. Ellion et al (U.S. Pat. No. 4,272,257) is typical of these patents which rely on surface tension to allow liquid to flow and prevent the discharge of gas. A summary article for these zero-gravity rocket motor feed systems is given in the Journal of Spacecraft and Rockets Vol. 8 No. 2 February 1971 pages 83–88 by S. Debrok. Although these patents employ surface tension devices to prevent gas from leaving the container, none of them relates to spray bottles that operate in a gravity field and they all require multiple, complex, expensive porous entrance devices.

It is a principal object of this invention to provide a feed system for a hand held spray bottle that is usable when the bottle is at any orientation.

It is another object of this invention to provide a feed system that operates automatically without requiring manipulation on the part of the user.

It is yet another object of this invention to be able to operate this container feed system on earth and consequently in a gravity field or at any gravity level above or below earth's gravity level.

It is still another object of this invention to provide the features of this invention at very low cost of production.

It is still another object of this invention to provide a simple, inexpensive feed system that requires little or no added assembly steps over those required for the existing conventional spray bottles, and can be assembled with established production line equipment.

Other objects and advantages of this invention will become apparent from the following specifications and appended drawings.

BRIEF DESCRIPTION OF THE INVENTION

This invention is directed to a liquid separation feed structure wherein surface tension forces allow liquid but not gas to be expelled from a container regardless of its orientation. The feed structure has two openings. The first is the conventional opening at the bottom of the dip tube. The second opening is close to the top of the dip tube. The term "top" means its upper extremity when the bottle is in its upright position. The material of this second entrance port of the feed system contains unique small openings which, when wetted by the liquid, provide a surface tension force that prevents gas from entering, but will pass the liquid freely. A number of embodiments are described, including: a dip tube that is fabricated entirely of a porous material; an insert at the exit end of the conventional dip tube that is fabricated of a porous material; a porous member in the hand pump or valve in the case of the pressurized can in the location where the dip tube attaches; and slotted members in dip tube, hand pump or exit port that provide narrow flow passages instead of porous material. The maximum size of the pores in the embodiments utilizing porous material is given in the extreme as four times the surface tension of the liquid divided by the atmospheric pressure in the container with a hand pump. For the pressurized aerosol can configuration, the maximum pore size is equal to four times the liquid surface tension divided by the difference between the gas pressure and one atmosphere. The maximum size of the gap in the embodiments utilizing slots is given in the extreme as two times the surface tension of the liquid divided by the atmospheric pressure in the container with a hand pump. For the pressurized aerosol can configuration, the maximum gap is equal to two times the liquid surface tension divided by the difference between the gas pressure and one atmosphere.

The material of the second entrance may be composed of numerous small pores or could be composed of thin elongated passages such as those formed by concentric cylinders whose external diameters are slightly smaller than the mating cylinder's internal diameter and thus form thin circular passages. Another configuration of the second opening material could be layered disks that form parallel thin entrances. Yet another is a properly proportioned slot through the wall of the dip tube. Still another configuration for the second opening employs a flow passage formed by a gap between the dip tube and the entrance to the hand pump or exit value of the pressurized can.

The above and other features of this invention will be fully understood from the following detailed description and the accompanying drawings, in which:

BRIEF DESCRIPTION OF THE DRAWINGS

FIG. 8 is an axial cross-section of a concentric cylinder gas-excluding device useful in the hand pump of FIG. 7;

FIG. 9 is an exploded view of FIG. 8;

FIG. 10 is a view taken at line 10—10 in FIG. 9;

FIG. 11 is a view taken at line 11—11 in FIG. 9;

FIG. 12 is an exploded cross-section view of another embodiment of a gas-excluding device useful in the hand pump of FIG. 7;

FIG. 13A is an axial cross-section of FIG. 12, assembled for upright operations;

FIG. 13B is a view identical to FIG. 13A, but for inverted operations;

FIG. 18 is a lateral cross-section taken at line 18—18 in FIG. 19 for inverted operation;

FIG. 19 is a fragmentary axial cross-section taken at line 19—19 in FIG. 18, showing yet another embodiment of gas-excluding means for inverted operation;

DETAILED DESCRIPTION OF THE INVENTION

Figure 1:
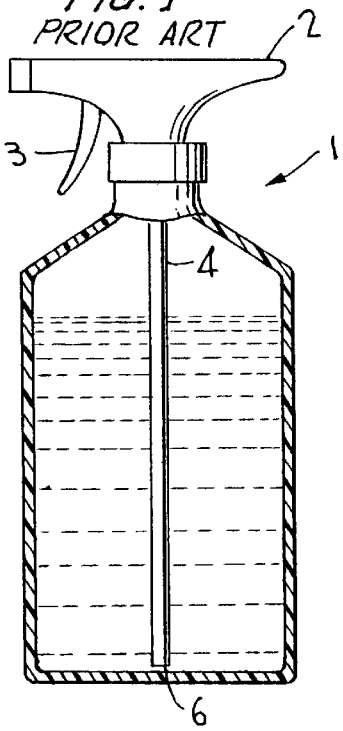
FIG. 1 PRIOR ART
FIG. 1 is a side view partly in cutaway cross-section showing a conventional hand pump spray bottle.

FIG. 1 illustrates a conventional spray bottle with an existing conventional hand pump 2. The conventional hand pump has a lever 3 that controls the volume of a cylinder (not shown) in the pump. The internal passage of the dip tube 4 is connected to the cylinder and has one end 6 open in order to admit the liquid 5. When the cylinder volume increases, the pressure within it decreases, and thereby causing liquid 5 to flow into the open end of the dip tube 6 and through the internal passage into the cylinder. When the cylinder volume is decreased, the pressure of the liquid within it increases and forces the valve that connects the cylinder to the dip tube to close, it also forces a spring loaded exit valve to open and expel the liquid. This conventional hand pump functions well if the open end of the dip tube is in contact with the liquid. However, if the open end 6 of the dip tube 4 is not in contact with the liquid, as would occur if the bottle is inverted, only gas could be expelled.

Figure 2A:
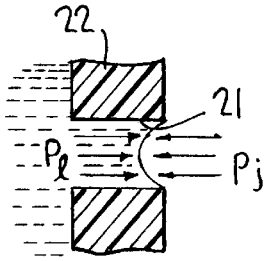
FIG. 2A is an illustration of a small pore in cross section with liquid on one side and a gas on the other.
Figure 2B:
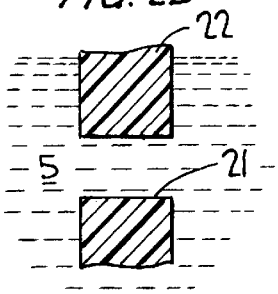
FIG. 2B is an illustration of the same pore when completely surrounded by liquid.

Before the detailed operation of this invention can be fully understood, it is necessary to explain how the surface tension can allow liquid to pass through a pore while preventing the passage of gas. FIGS. 2A and 2B illustrate a theoretical pore 21 that is contained in dip tube wall 22 which is wettable by the liquid. FIG. 2A is a view of the port after liquid has been drawn into the interior of a dip tube a portion of which contains material 22 with pores 21 in it.

Liquid is shown on one side, and gas on the other side. For simplicity of explanation, consider the pore to be circular and perfectly wettable. The gas will not enter the pore as long as the force of the gas against the liquid in the pore is less than the force that is holding the liquid in the pores. There are three separate forces of interest in this case that result from: the gas pressure ($P_g$), the liquid pressure ($P_l$) and the surface tension (s) of the liquid. More specifically, the gas will not enter the pores if the product of the gas pressure times the cross sectional area of the pore is equal to or less than the value of the liquid pressure times the cross sectional area of the pore plus the surface tension times the circumference of the pore:

$$P_g \pi D^2/4 \leq P_l \pi D^2/4 + \pi D s \quad (1)$$

equation (1) can be rearranged to give the maximum pore size diameter that will prevent gas from entering the wetted pore, as follows:

$$D \leq 4s/(P_g - P_l) \quad (2)$$

For the hand pump, the minimum possible liquid pressure is slightly greater than zero during the end of a perfect suction stroke. The maximum size pore can be calculated by assuming that, in the extreme, the liquid pressure is zero. Thus the maximum pore size would be given by equation (3) with the value of $P_l$ set equal to zero.

$$D \leq 4s/P_g \quad (3)$$

For the case of a pressurized aerosol can, the minimum possible liquid pressure in the extreme case would be atmospheric pressure. Thus the maximum pore diameter is given by placing $P_l$ equal to $P_{atm}$ in equation (2) to become:

$$D \leq 4s/(P_g - P_{atm}) \quad (4)$$

Equations (3) and (4) define the maximum sized pores that are needed to allow liquid to flow through the pores but which will prevent any flow of gas with the assumed extreme value of the liquid pressure. It is seen that if the pressure of the liquid is not at the extreme low values assumed above, the pore sizes could be larger than specified in equations (3) and (4).

FIG. 2B illustrates a segment of the porous wall that is wetted with liquid on both the interior and exterior of the entering port segment. It is seen that there is no liquid-gas interface so that there is no surface tension force and the liquid can flow freely through the pore, being slowed only by the surface friction of the pore wall.

In this example, the circumference and cross-section area are readily derived from the diameter. The same criteria exist for packed spheres, for rectangular weaves, and for other shapes. The circumference (perimeter) will be determined and the cross-section calculated. With these and the knowledge of the surface tension, the necessary sizes can be calculated and the product made accordingly.

It is seen that for circular pores the wetted pore diameter must be less than 4 times the surface tension of the product to be dispensed, divided by the gas pressure on one side of the pore minus the liquid pressure on the other side of the pore. When the system is not operating, the pressure of the liquid on one side of the pore is equal to the pressure of the gas on the other side, minus the product of the liquid density times the height of the specific pore above the liquid level in the container. This is well-known from standard hydraulics. When the system is dispensing the product, the liquid pressure drops by the amount of the suction from the pump.

As an example, a typical hand pump bottle is 8 inches tall. For simplicity of illustration, this example will be for dispensing liquid water. In the extreme case, the liquid inside the porous material when not operating will be at a pressure equal to that of the gas in the bottle minus the product of the liquid density times the 8 inch height. Since the gas within the bottle is at atmospheric pressure, the extreme pressure when not operating, if the liquid is water, would equal the atmospheric pressure (14.7) minus the density of water times the height (0.0361 times 8) or 14.41 psi. A typical hand pump with a typical dip tube will decrease this pressure only by approximately 0.1 psi during the suction stroke. As a result the porous material must withstand a pressure difference of (14.7−14.41+0.1)=0.39 psi. Use of the equation (2) shows that the maximum allowable pore diameter would equal 4 times the surface tension (4.16×10−4) divided by the pressure difference (0.39) which equals 0.0043 inches or 108 microns.

The pore size for a pressurized container can be obtained in a similar fashion. In this case, instead of employing the suction pressure of the hand pump, the added pressure difference in place of the pump suction pressure would be the pressure of the propellant gas minus the pressure at the exit orifice, which in the extreme is close to atmospheric.

In a similar manner, the pore size for a squeeze bottle can be determined by using the value for the added pressure difference in place of the pump suction pressure for the internal pressure when squeezed, minus the pressure at the exit orifice, which is close to atmospheric.

Now that the operation of a wettable porous material has been explained, the design of a spray bottle that utilizes the principle can be described. The following description illustrates the application to a hand pump bottle. The discussion is equally applicable to a pressurized aerosol can or to a squeeze bottle.

Figure 3:
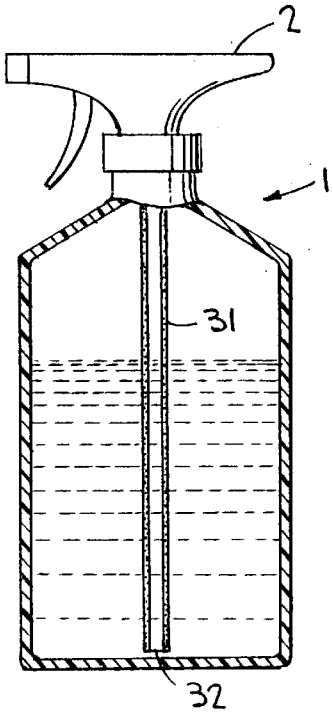
FIG. 3 is a side view partly in cutaway cross-section showing a conventional hand pump spray bottle with a porous wall dip tube.

FIG. 3 illustrates one embodiment where the conventional dip tube 4 is replaced with a porous wall dip tube 31 having substantially the same internal and external diameters as the conventional tube. The size of the pores is determined by equations 3 or 4. When the bottle 1 is upright and the hand pump is activated, liquid is drawn into the open end 32 of the dip tube. Although a portion of the porous dip tube is exposed to gas in the bottle, the gas is prevented from entering the dip tube by the liquid surface tension force as described previously.

Gas will also be prevented from entering the hand pump when the bottle is inverted. The operation when the bottle is inverted requires further explanation to understand why it is possible to have an open end in the dip tube that is exposed to gas, and in which the open end does not need a porous entrance.

Figure 4:
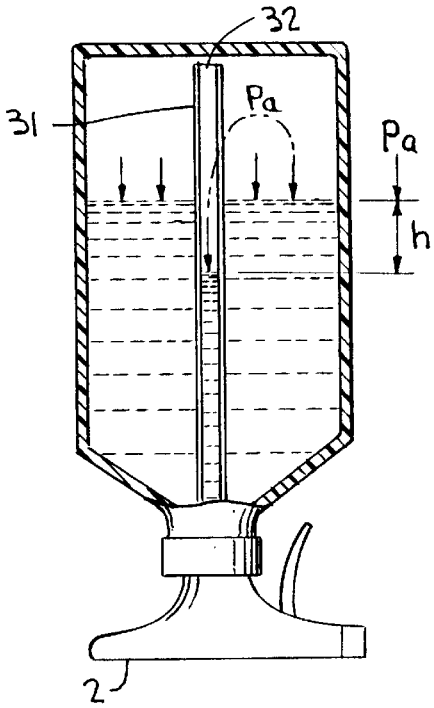
FIG. 4 illustrates the liquid levels when the bottle is inverted during the pump suction stroke.

When the bottle is inverted as illustrated in FIG. 4 and the hand pump is not operating, the liquid within the porous dip tube 31 falls to the same level as the liquid in the bottle. When the hand pump 2 is activated, liquid flows from the interior of the dip tube 31, to the pump 2 and this quantity of liquid is only partially replaced by the liquid flow through the porous walls of the tube 31. The result is that the liquid level in the dip tube 31 falls a slight amount h. During the suction stroke of the hand pump, the liquid in the porous tube will fall an amount, as known from standard hydraulic analysis, equal to the amount h as specified by equation (5):

$$h = \Delta P/d \quad (5)$$

where:

ΔP is the pressure drop of the liquid as it flows through the porous wall d is the density of the liquid Tests with a typical spray bottle and hand pump with a dip tube having a porous wall with pores having maximum diameter of 0.003 inch and immersed in 8 inches of water have shown that the liquid level for water drops an amount, h, equal to 0.5 inches. This result shows that the last 0.5 inches of water can not be pumped out if the bottle is inverted. However, all of the water, with the exception of this 4 inches of water can be pumped out of the inverted bottle even with an open entrance at the end 32 of the dip tube. It should be noted that all of the liquid can be pumped out of the upright bottle when the open end 32 of the dip tube is in contact with the liquid.

The pressure drop, ΔP, of the liquid flowing through the porous wall depends directly on the cross-sectional area of the flow passage. A second embodiment of this invention has a large flow area in order to decrease the quantity of liquid that can not be pumped when the bottle is inverted.

Figure 5:
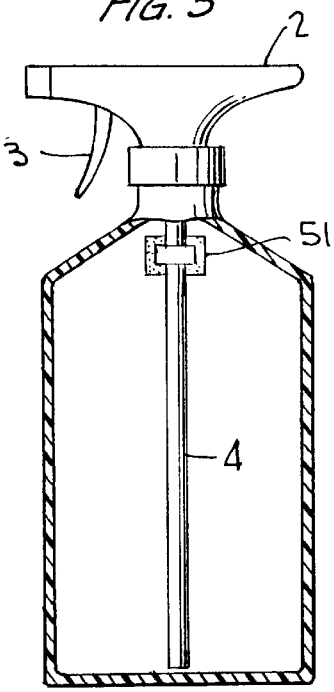
FIG. 5 illustrates the porous insert at the top of the conventional dip tube.

The second embodiment of this invention employs a conventional solid wall dip tube 4 with a large diameter porous cylinder 51 connected to the end of the dip tube and then to the hand pump as illustrated in FIG. 5. The result is that the flow area of the porous attachment is greater and the pressure drop is decreased. Consequently, more liquid can be pumped out of the inverted bottle. For example, if the porous attachment has the same wall thickness as the porous dip tube in the first embodiment, but is ten times the diameter, the quantity of liquid that can not be pumped out of the inverted bottle will be decreased by a factor of ten. Instead of 0.5 inch of liquid remaining, there would only be 0.05 inches.

The second embodiment (FIG. 5) has an added advantage of requiring a lesser amount of porous material with an accompanying savings in cost. However, it does require an additional assembly step to assemble the porous attachment 51 to the dip tube 4. A third embodiment provides increased flow area. It combines the advantage of requiring only a smaller quantity of the porous material and eliminates the additional assembly step. It provides increased flow area, and does not add an additional assembly step.

Figure 6A:
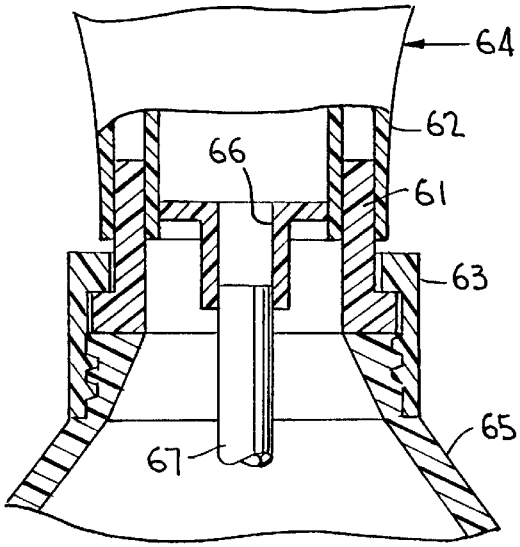
FIG. 6A PRIOR ART
FIG. 6A illustrates a conventional hand pump spray bottle.
Figure 6B:
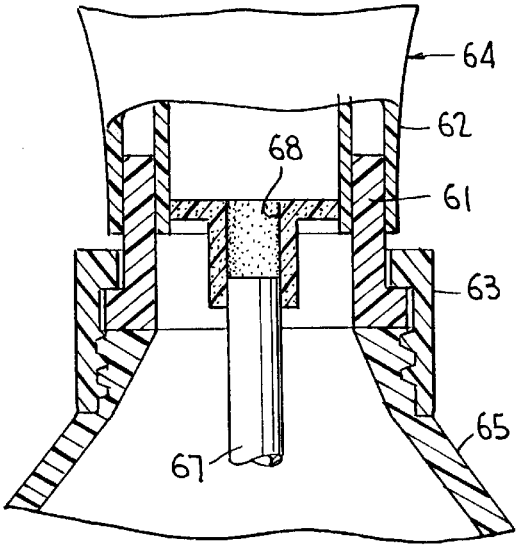
FIG. 6B illustrates the porous entrance as part of the hand pump.

The third embodiment FIGS. 6A and 6B increases the flow area over the porous dip tube and thus increases the quantity of liquid that can be pumped from the inverted bottle without the added assembly step. FIG. 6A illustrates a portion of one of many available hand pumps. It can be manufactured and assembled entirely by automatic machines. It is typical of most of the available hand pumps. An in insert 61 attaches a nut 63 to the base 62 of the hand pump 64. The nut 63 in turn attaches the hand pump 64 to the bottle 65. A separate insert 66 is pressed into the base 62 of the hand pump 64 so that the dip tube 67 can be attached.

FIG. 6B illustrates the same hand pump 64 and the same attachment nut 63 but with the solid insert 66 replaced with a porous insert 68. This porous insert can be fabricated and assembled to the pump at the same cost as the solid insert. The only increase in cost would be the difference between the cost of the solid material and the cost of the porous material.

The porous material can be made from a polymer solution that comprises a solute and a solvent. Polystyrene and polyethylene are suitable examples. As the temperature of the solution is lowered, the solvent will separate from the solute, and small globules of the solvent would be formed. Removal of the solute leaves a suitable porous material. The pore size is controlled by the rate at which the solution is cooled. Some experimentation may be necessary to arrive at suitable process parameters. Any suitable solvent can be used in which the solubility of the polymer decreases with decreasing temperature so that the polymer will precipitate out as it is cooled. This solid material can be shaped by processes such as casting or extruding.

Another method to make a structure with a suitable pore size is to sinter spherical particles together in a body. The interstitial spaces will have known dimensions when particles of known diameter are used. Glass, metal, or plastic particles may be sintered or fused for this purpose.

These and other methods to produce porous material of known composition and dimensions are well known to persons skilled in the art.

Another example of a suitable material is multiple layers of a nylon weave, similar to that used in women's hosiery having equivalent pore orifices of about 0.003 inches by about 0.003 inches. This material is suitable for use as the porous material.

Numerous other processes exist that will produce suitable porous material. A person skilled in the art can readily select such processes.

It should be understood that the invention will not function properly unless the pores in the one entrance are wetted with the liquid to be expelled. When the bottle is first activated, it should be inverted to allow the liquid to wet the porous entrance. Then the hand pump, the exhaust valve, or the bottle will be squeezed to cause the liquid to flow into the pores. The feed system will remain primed indefinitely unless the container is subjected to severe vibrations. Test containers have remained primed for over 14 months in storage after being primed at the start of the test. As a result the priming action usually needs to be performed only once.

The discussion to this point has been concerned with a material that has numerous small individual pores that cover the second entrance that leads to the exit to the bottle. There is another concept which also employs surface tension forces to prevent the escape of gas and also allow the flow of liquid when the bottle is inverted. This concept employs thin passages rather than individual pores.

Figure 7:
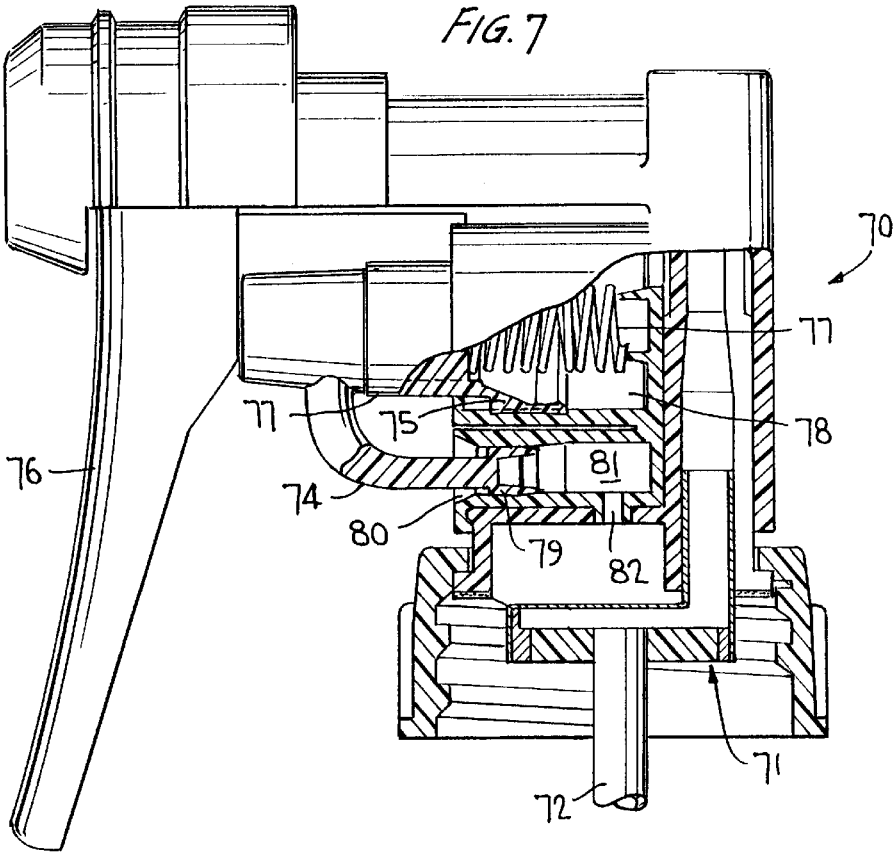
FIG. 7 is an axial cross-section of a hand pump with one embodiment of this invention.

FIG. 7 illustrates one embodiment of the thin passage concept, installed in a conventional hand pump 70. A concentric cylinder assembly 71 and a conventional dip tube 72 are installed in a conventional hand pump 70. The concentric cylinder assembly 71 with flow passages 73 is separately illustrated in FIG. 8, removed from the hand pump, together with the conventional dip tube 72. The concentric cylinder assembly 71 is shown disassembled in FIG. 9. A main case 91 has an internal diameter 92 that is sized to accept three spacers 93 on the first cylinder 94 in order to form thin cylindrical passages 73 of height "t" as illustrated in FIG. 10. In a similar manner, the first cylinder 94 has an internal diameter 95 that is sized to accept three spacers 96 on a second cylinder 97 in order to form thin cylindrical passages of height "t" as illustrated in FIG. 11.

The required height "t" of the thin passages can be determined, for the case where "t" is small compared to the diameter of the cylinders, by considering the force balance between the gas pressure, the liquid pressure in the thin passages and the surface tension forces, as follows:

$$P_g \pi Dt \leqq P_l \pi Dt + 2\ \pi Ds\ \mathrm{Cos}\ (a)$$

or:

$$t \leqq 2s\ \mathrm{Cos}\ (a)/(P_g - P_l) \qquad (6)$$

where:

$P_g$ is the pressure of the gas in the bottle $P_l$ is the pressure of the liquid in the thin passage during upright operation s is the surface tension of the liquid t is the height of the thin passage Cos(a) is the cosine of the contact angle of the liquid within the thin flow passages (for most liquids of interest the contact angle is zero since the passages would be wetted by the liquid).

Figure 23:
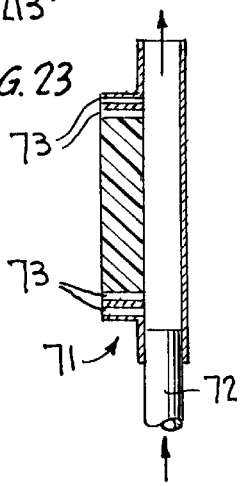
FIG. 23 illustrates cylinders with flow perpendicular to the dip tube axis.

The total flow area in the thin passages should be approximately equal to the flow area through the unrestricted entrance in order to limit the pressure drop and as result prevent ingesting air during inverted operation. Thus the number of concentric cylinders that are required depends on the cross-sectional area of the dip tube. For example, if the cylindrical flow passages controlled by the spacers 93 and 96 are 0.8 and 0.7 inches in diameter respectively and the height of the thin passages is 0.002 inches, the two cylinders illustrated in FIG. 9 would provide approximately the same flow area as a conventional dip tube having an internal diameter of 0.1 inches. FIG. 23 illustrates another configuration where the flow through the cylinder assembly is perpendicular to the dip tube axis.

FIG. 12 illustrates yet another disassembled concept. In this embodiment, the flow passages in the inverted position are formed by stacked disks. In this Figure, three disks 101, 102 and 103 are illustrated in a disassembled mode.

Figure 24:
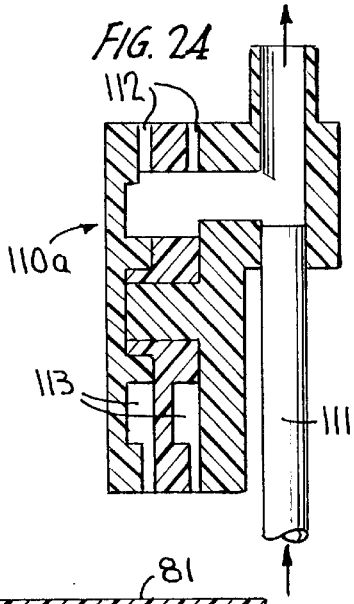
FIG. 24 illustrates stacked discs with flow parallel to the dip tube axis.

FIGS. 13A and 13B illustrate the assembled disks 110 with a conventional dip tube 111. The three disks form flow entrance passages 112 (FIG. 13B) when the bottle is inverted. The thin flow entrance passages would have too high a pressure drop if they extended entirely across the disk. In order to reduce the pressure drop, the flow passages are enlarged considerably to form low pressure flow passages 113. FIG. 13A illustrates the operation when the bottle is in the upright position. The liquid in the thin flow passages 112 between the disks forms a seal by surface tension force that prevents gas from entering the disk assembly when the bottle is upright and the disks are exposed to gas. FIG. 11B illustrates the operation when the bottle is inverted. The disks are immersed in liquid and, since there is no gas liquid interface, there is no surface tension force and the liquid flows freely through the thin passages. FIG. 24 illustrates another configuration where flow through the disc assembly is substantially parallel to the dip tube axis.

The height of the thin passages can be determined by considering the force balance between the gas pressure, the liquid pressure in the thin passages during upright operation, the surface tension forces, and the liquid contact angle. The result of this analysis for the height of the thin passages "t" is the same as for the concentric cylinders.

The concepts of forming the required thin slots with concentric mating cylinders or layered disks are desirable concepts. However, it is also possible to form the required thin slot in an existing solid wall dip tube so that no additional parts would be required.

Figure 14:
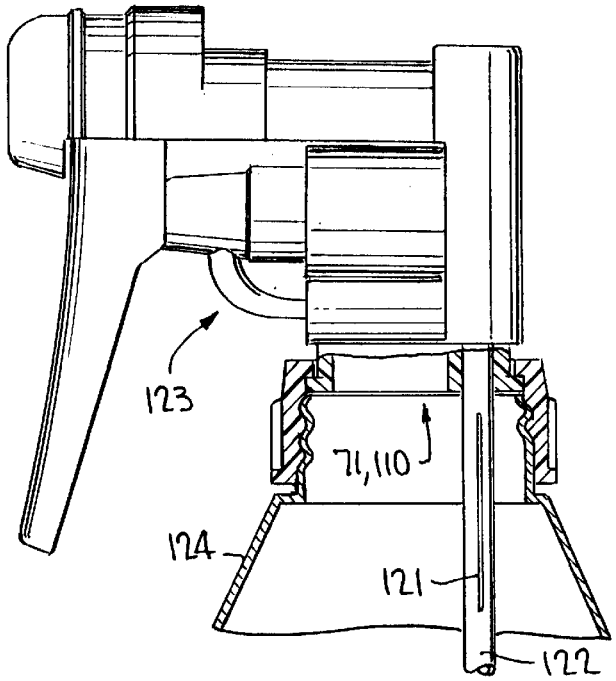
FIG. 14 is a view principally in axial cross-section showing a hand pump incorporating another embodiment of gas-excluding means.

FIG. 14 illustrates a required thin slot 121 formed through the dip tube 122 near the conventional hand pump 123 of a conventional spray bottle 124. In this concept, as was the case with the concentric cylinders and stacked disks, the slot should be approximately 0.002 inches wide and approximately 2 inches long. As discussed previously for the cylinders and the disks, a 0.002 inches wide slot will prevent air from entering the exit port during upright operation and will allow sufficient liquid to flow through the slot to the exit during inverted operation.

The problem of fabricating the thin slot in the dip tube can be solved by using a laser to cut the slot. This fabrication technique is well known but its cost is larger than desirable for incorporation into an inexpensive spray bottle.

It has been found that using a conventional heated safety razor blade which is 0.012 inches thick to cut a slit in the wall of a typical dip tube resulted in the desired equivalent slot. If a 2 inch long section of the dip tube is merely parted by the hot razor, the bounding regions of the dip tube around the cut cause the cut section to close partially back when the razor is removed, but fortuitously the distortion will have caused a permanently open slot of desirably small width. The result is that an opening that is equivalent in surface tension effects to a 0.001 to 0.004 inch slot is created in the conventional dip tube. The fortuitous result is that a section of the dip tube can be slitted in mass production at a cost of less than 5 percent of the cost of the concentric cylinders or of the stacked disks. With this concept, a spray bottle with the advantages of this invention can be manufactured at a cost of less than 1/10th of a cent more than the cost of the conventional bottle. This cost increase is easily absorbed from increased sales and makes the invertable spray bottle for the first time economically feasible.

Figure 15:
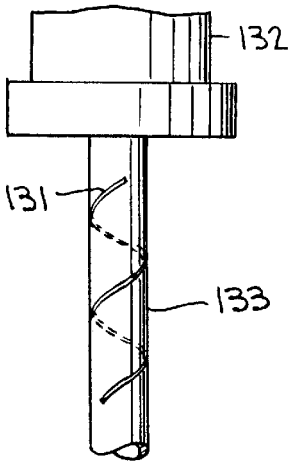
FIG. 15 is a fragmentary side view showing yet another embodiment of gas-excluding means.

It is desirable to have the slot 121 closer to the hand pump 132 so that in the inverted position, most of the liquid product can be dispensed. To accomplish this, a slot 131 can be made to curve around a dip tube 133 as illustrated in FIG. 15.

Figure 16:
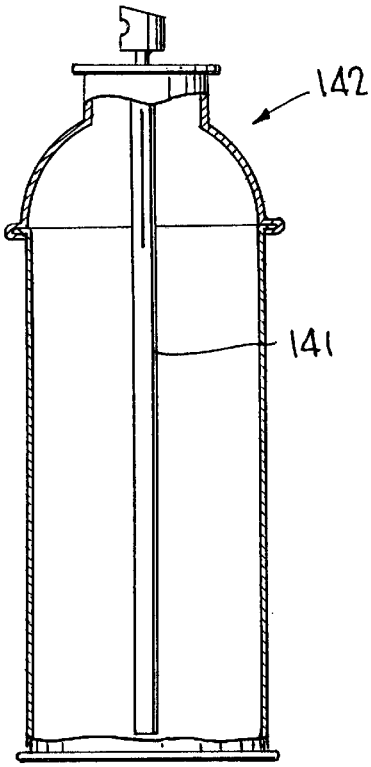
FIG. 16 is a cutaway view of a pressure container including the gas-excluding means of FIG. 14.

FIG. 16 illustrates a slotted dip tube 141 installed in a pressured aerosol can 142.

Figure 17:
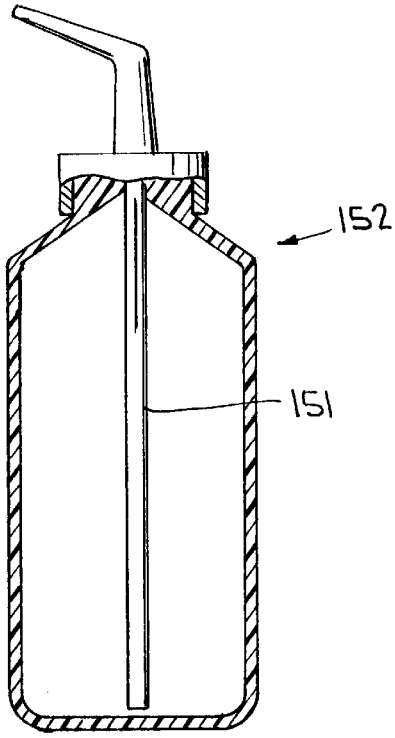
FIG. 17 is a cutaway view of a squeeze bottle including the gas-excluding means of FIG. 14.

FIG. 17 illustrates a slotted dip tube 151 installed in a squeeze bottle 152.

There is another embodiment for the invertable spray bottle that will require no additional parts to the existing hand pump trigger and thus result in minimum cost. In order to convert a conventional hand pump to one that will operate in the inverted position, it is only necessary to enlarge the diameter of the entrance port to the trigger a slight amount and put a slot in the mating end of the dip tube. The operation can be understood by considering FIG. 7 which illustrates a typical prior art trigger 70 for a spray bottle. The entrance port 73 is sized to admit and retain the dip tube 72 in the conventional trigger.

FIGS. 18 and 19 illustrate a modified trigger 120 in the inverted orientation. In order to modify the typical prior art trigger 70, the entrance port 125 is enlarged to be slightly greater (0.002 to 0.008 inches) than the diameter of the dip tube 122 for a short length. FIG. 19 illustrates an enlarged view in cross-section of the entrance port 125 and the dip tube 122.

A slot 126 is cut in the wall of the entrance port to the hand pump for a short length of the port which has the enlarged diameter 134. The dip tube 122 is also slotted at 135 for the same length but it is located diametrically across from the slot in the wall of the entrance port. The gap 136 that is formed between the enlarged diameter of the trigger inlet port 121 and the dip tube 122 provides a flow passage 136 for the liquid to be dispensed. The size "t" of this flow passage 136 is determined by equation 6. The length of the slot is determined by considering the amount of liquid that is dispensed for each stroke of the trigger. For existing conventional triggers, the slot should be approximately ¾ inches long.

It should be noticed that the liquid to be dispensed is drawn into the slot 126 in the entrance port 121, then through the passage 136 around the dip tube 122 to the slot in the dip tube 135 and into the dip tube 122. The liquid then flows to the trigger and finally to the exit. It is not necessary to have the slot 126 precisely diametrically opposite slot 135. Only a small portion of the solid wall of the dip tube needs to separate the two slots.

Triggers of this design have been made and have dispensed the entire contents of spray bottles in either the upright or the inverted positions. These triggers for dispensing typical detergent liquids having surface tensions of approximately 30 dynes/cm had a flow passage formed by a slot ¾ inch long, an inlet port diameter of 0.164±0.002 inches and a dip tube outside diameter of 0.16 inches.

Triggers with other dip tube diameters also operate satisfactory as long as the flow passage width is 0.003±0.002 for the typical detergent liquids.

In any of the above embodiments, the triggers for the spray bottles must have some mechanism to allow outside air to enter the bottle to replace the liquid that is dispensed in order to avoid creating a vacuum in the bottle. A problem arises since this mechanism allows liquid to leak when operated in the inverted position.

FIG. 7 illustrates one embodiment of this invention installed in a typical prior art spray bottle trigger 70 having a mechanism for allowing air to enter the bottle. The arm 74 is attached to the main piston 75 which in turn is moved by the lever 76. When the lever 76 is pulled, the piston 75 moves against the spring 77 to expel any liquid that is contained in the cylinder 78 which was drawn from the bottle during the previous movement of the piston 75. When the arm 74 is displaced it also moves piston 79 and allows outside air to enter port 80 through cylinder 81 to entrance port 82 and then into the bottle in order to replace the liquid that had been dispensed.

In the inverted position when the trigger is actuated, liquid tends to be forced into the port 82 and out of the port 80 by the head of the liquid in the bottle. When the bottle is full, the head of liquid is approximately 8 inches to give a pressure of approximately 0.28 psi above the air pressure at the entrance port 80 for typical products in the bottle. If the trigger is actuated in the inverted liquid position, liquid in the bottle will flow out of the air entrance port 80 by the force of gravity. This is undesirable.

Figure 20A:
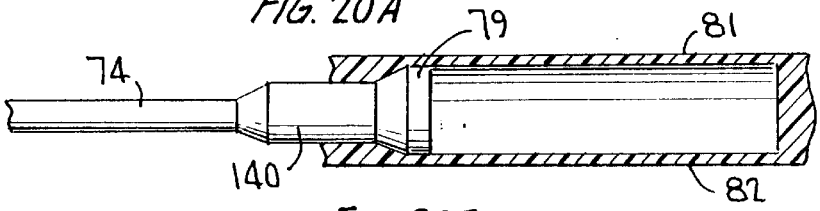
FIG. 20A is a fragmentary cross-section showing a vent device in one position for use in the hand pump of FIG. 7.
Figure 20B:
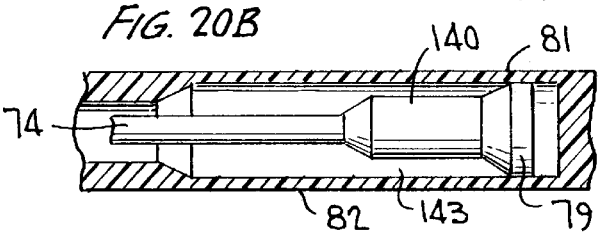
FIG. 20B is a view similar to FIG. 20A in another operating position.

The solution to prevent liquid leakage and also to admit air when operating in the inverted position is illustrated in FIGS. 20A and 20B. FIG. 20A illustrates the piston 79 positioned during non operation of the trigger. FIG. 20B illustrates the position of the piston 79 when the trigger is activated to dispense the liquid in the bottle. This embodiment utilizes the surface tension forces that have been described in this patent. To prevent liquid from leaking during the inverted operation, the piston 79 has a cylindrical section 140 that is slightly smaller diameter than the cylinder 81 so as to form a thin gap 143 between the piston 79 and the cylinder 81 when the piston 79 is in the position to open port 82 as illustrated in FIG. 20B. From equation 6, a gap of 0.003 inches will stand a liquid head of 8 inches. Test have confirmed that if this gap 143 is 0.003±0.001 inches, liquid detergents will not leak our during inverted operation because of surface tension forces, but air can enter the bottle after the air pressure in the bottle decreases by about 0.28 psi. This small decrease in pressure does not affect the operation and will not deform the typical plastic bottle by any noticeable amount. This is a simple, reliable, inexpensive embodiment of the surface tension force principle that is taught in this patent which will prevent liquid from leaking out of the bottle during inverted operation.

Figure 21A:
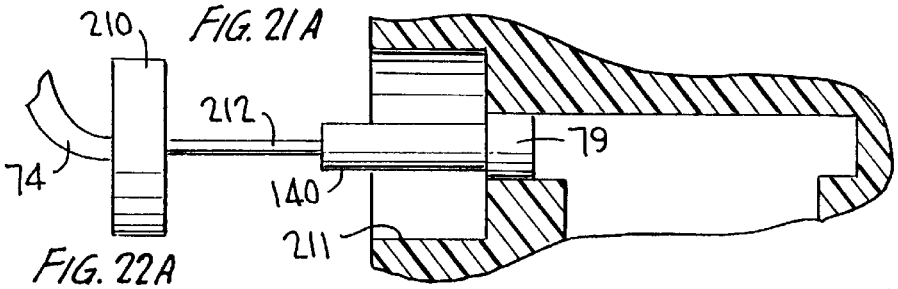
FIG. 21A is a fragmentary cross-section of an alternate vent device.
Figure 21B:
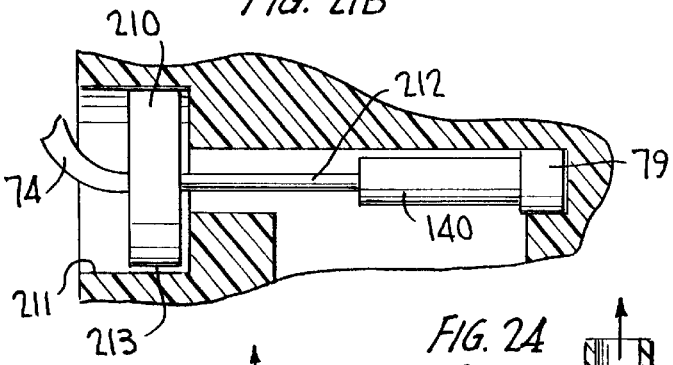
FIG. 21B is a view similar to FIG. 21A in another operating position.

While the configuration illustrated in FIGS. 20A and 20B functions as intended for most hand pumps, the amount of air admitted during each stroke of the pump is too small to prevent the plastic bottle from collapsing during operation if a very strong hand pump is employed. FIGS. 21A and 21B illustrate a modification of the air inlet port that will allow a greater amount of air to enter the bottle during each stroke of the hand pump. This configuration has a similar cylindrical section 140 attached to the air piston 79 as in the configuration illustrated in FIGS. 20A and 20B. It has an additional larger cylinder 210 attached to the cylindrical section 140 by arm 212 as illustrated in FIGS. 21A and 21B. When the hand pump reaches the near end of its stroke, the gap 143 disappears and the larger cylinder 210 enters the cylinder 211 which has an internal diameter approximately 0.006 inches larger that the outer diameter of cylinder 210. The resulting gap 213 provides a larger flow area for the entering air than was available from gap 143 in the configuration illustrated in FIGS. 20A and 20B. The result is that sufficient air can enter the plastic bottle when using any available hand pump and thus prevent the bottle from collapsing.

Figure 22A:
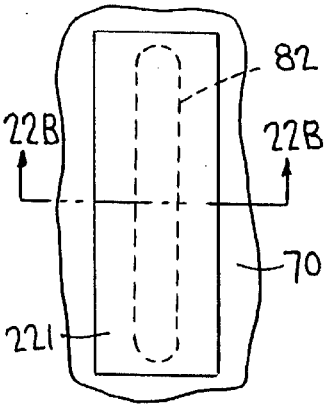
FIG. 22A is a plan view of an alternate vent device.
Figure 22B:
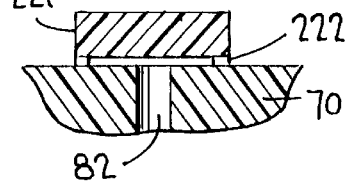
FIG. 22B is a cross-section of the device illustrated in FIG. 22A.

FIGS. 22A and 22B another configuration that also would allow more air to enter the bottle than the configuration illustrated in FIGS. 20A and 20B. In this configuration, a piece 221 is inserted inside the hand pump 60 and across the air inlet port 82 of FIG. 7. FIGS. 22A and 22B this piece 221 that stands-off of the air inlet port 82 to form a thin passage 222. The size of the inlet port 82 and the size of the passage will determine the size of the area through which the air enters the bottle. Conventional hand pumps can accommodate inlet port areas up to 0.2 square inches. The resulting air inlet flow area would be ten times greater than that illustrated in FIGS. 20A and 20B.

In this specification, the term "gas rejection means" is used to describe the porous material, and the channels and slots, which when wet prevent the passage of gas. The term "ejection means" is used to describe the means for releasing liquid from the container, for example, the hand pump (trigger), the exit valve, and the flexible portion of a squeeze bottle.

This invention is not to be limited by the embodiments shown in the drawings and described in the description, which are given by way of example and not of limitation, but only in accordance with the scope of the appended claims.

We claim:

1. Apparatus for containing and dispensing liquid contained therein while in any orientation, comprising:

a container having a container wall forming a storage cavity, and an opening through said container wall into said cavity;

ejection means mounted to said container;

a dip tube having a peripheral wall, and a passage therethrough, said dip tube being mounted to said ejector means with said passage in fluid communication with said ejector means, and a port opening into said cavity at a location spaced from said ejector means;

gas rejection means close to said container opening comprising a flow channel in fluid communication with said cavity, with said ejector means, and with said passage, said channel being so proportioned that when wet it will have the property to permit flow of liquid in said cavity to said ejector means, and to prevent flow of gas from said cavity to said ejector means, whereby when the container is in an upright position, liquid can be removed from the cavity through said port in said dip tube, and when in an inverted position with the port out of the liquid and the gas rejection means submerged in said liquid, liquid can be removed from the cavity through said channel.

2. Apparatus according to claim 1 in which said channel is circular with flow therein substantially parallel to the axis of the dip tube, said channel having a width and length such as to produce said proportion and flow properties.

3. Apparatus according to claim 1 in which said channel is circular with flow therein substantially perpendicular to the axis of the dip tube, said channel having a width and length such as to produce said proportion and flow properties.

4. Apparatus according to claim 2 in which said channel is formed by a plurality of nested cylinders, one said cylinders having a respective outer diameter and inner diameter different from one another, and a height, whereby said width and length of said channel produces said proportion and flow properties.

5. Apparatus according to claim 3 in which said channel is formed by a plurality of nested cylinders, one inside the other, said cylinders having a respective outer diameter and inner diameter different from one another, and a height, whereby said width and length of said channel produces said proportion and flow properties.

6. Apparatus according to claim 1 in which said channel is circular with flow therein substantially radial to the axis of the dip tube, said channel having a width and length such as to produce said proportion and flow properties.

7. Apparatus according to claim 1 in which said channel is circular with radial flow therein substantially in a plane parallel to the axis of the dip tube, said channel having a width and length such as to produce said proportion and flow properties.

8. Apparatus according to claim 6 in which said channel is formed by a plurality of stacked discs, said discs having upper and lower faces, said channel being formed by abutting one of said faces, whereby said width and length of said channel produces said proportion and flow properties.

9. Apparatus according to claim 7 in which said channel is formed by a plurality of stacked discs, said discs having front and back faces, said channel being formed by abutting one of said faces, whereby said width and length of said channel produces said proportion and flow properties.

10. Apparatus according to claim 1 in which said channel is linear with flow therein substantially perpendicular to the dip tube axis, said channel having a width and length such as to produce said proportion and flow properties.

11. Apparatus in according to claim 10 in which said channel is formed by a slit through said dip tube peripheral wall, said slit having said width and length such as to produce said proportion and flow properties.

12. Apparatus in according to claim 11 in which said slit is formed by a laser beam to form a functionally suitable proportioned channel.

13. Apparatus according to claim 11 in which said slit is formed by a hot thin knife blade to form a functionally suitably proportioned channel.

14. Apparatus according to claim 10 in which said channel is formed by a slit through the wall forming the entrance to the hand pump, said slit having said width and length such as to produce said proportion and flow properties.

15. Apparatus according to claim 1 in which said channel is formed by a helical slit through said dip tube peripheral wall, said slit having a width and length such as to produce said proportion and flow properties.

16. Apparatus according to claim 1 in which said channel is formed by a helical slit through the wall of the entrance to the ejection means.

17. Apparatus according to claim 1 in which said channel is formed by two hollow cylinders, one inside the other, one said cylinder having an outer diameter smaller than the other said cylinder's inner diameter, and each of said cylinders having an axial slot displaced circumferentially from the other for flow to enter and leave said channel, said slot in fluid contact with the inside of the container and the other side slot in fluid contact with the ejection means, with flow in said channel substantially circumferential whereby said channel has width and length such as to produce said proportion and flow properties.

18. Apparatus according to claim 17 in which one of said cylinders is the dip tube and the other of said cylinders is the entrance to the ejection means.

19. Apparatus according to claim 1 in which said ejection means is a hand pump.

20. Apparatus according to claim 1 in which said ejection means is a pressure relief valve, said container being under pressure.

21. Apparatus according to claim 1 in which said ejection means is a flexible portion of said container, whereby said container can be squeezed to eject liquid.

22. Apparatus according to claim 1 in which said flow channel is substantially cylindrical with a diameter equal to or less than the value of four times the surface tension of the liquid being dispensed divided by the difference between liquid pressure at one end of the channel and gas pressure at its other end.

23. Apparatus for containing and dispensing liquid contained therein while in any orientation, comprising:

a container having a container wall forming a storage cavity, and an opening through said container wall into said cavity;

ejection means mounted to said container;

a dip tube having a peripheral wall, and a passage therethrough, said dip tube being mounted to said ejection means with said passage in fluid communication with said ejection means, and a port opening into said cavity at a location spaced from said ejector means;

gas rejection means close to said container opening comprising a flow channel in fluid communication with said cavity, with said ejection means, and with said passage, said channel being so proportioned that when wet it will have the property to permit flow of liquid in said cavity to said ejection means, whereby when the container is in an upright position, liquid can be removed from the cavity through said port in said dip tube, and when in an inverted position with the port out of the liquid and the gas rejection means submerged in said liquid, liquid will be removed from the cavity through said channel;

liquid rejection means comprising an outside air entry means having a flow channel in fluid communication with said cavity whereby the dispensed liquid can be replaced by outside air to prevent collapsing said container, said entry means with said channel being so proportioned that when wet it will have the property to prevent liquid from leaking from said container and when the pressure within said container decreases as the liquid therein is dispensed, outside air can enter the container.

24. Apparatus according to claim 23 in which said air entry means is a piston within a mating cylinder, said piston sealing the entrance to said container when in a nonoperating position and allowing communication between the inside and outside of the container when in operation, said piston having a cylindrical section whose diameter is smaller than the diameter of the mating cylinder forming said channel having the width and length such as to produce said proportion and flow properties.

25. Apparatus according to claim 23 in which said air entry means terminates as a port to the interior of said container over which is positioned a cover spaced away from said entry port so as to form a channel having width and length such as to produce said proportion and flow properties.

* * * * *